US006851344B1

(12) United States Patent
Wade

(10) Patent No.: US 6,851,344 B1
(45) Date of Patent: Feb. 8, 2005

(54) HAND TOOL WITH BIT CHANGING MECHANISM

(75) Inventor: Jimmy Wade, Boulder, CO (US)

(73) Assignee: Productworks LLC, Boulder, CO (US)

( * ) Notice: Subject to any disclaimer, the term of this patent is extended or adjusted under 35 U.S.C. 154(b) by 131 days.

(21) Appl. No.: 10/215,707

(22) Filed: Aug. 9, 2002

(51) Int. Cl.[7] ..... B25G 1/08
(52) U.S. Cl. ..... 81/490; 81/177.4
(58) Field of Search ..... 81/177.4, 490, 81/439

(56) References Cited

U.S. PATENT DOCUMENTS

| | | | | |
|---|---|---|---|---|
| 3,753,455 | A | | 8/1973 | Butler |
| 4,278,119 | A | | 7/1981 | Elmore |
| 4,463,788 | A | | 8/1984 | Corona et al. |
| 4,552,043 | A | | 11/1985 | Corona et al. |
| 4,572,038 | A | | 2/1986 | Graham |
| 4,716,796 | A | | 1/1988 | Corona et al. |
| 4,893,529 | A | | 1/1990 | Lin |
| 4,924,733 | A | | 5/1990 | McKenzie |
| 5,265,504 | A | | 11/1993 | Fruhm |
| 5,819,612 | A | | 10/1998 | Anderson |
| 5,842,394 | A | | 12/1998 | Hwang |
| 5,881,615 | A | | 3/1999 | Dahl et al. |
| 5,916,341 | A | | 6/1999 | Lin |
| 5,924,339 | A | | 7/1999 | Huang |
| 5,964,132 | A | | 10/1999 | Chen |
| 6,007,277 | A | | 12/1999 | Olson et al. |
| 6,029,549 | A | | 2/2000 | Baker |
| 6,032,332 | A | | 3/2000 | Lin |
| 6,053,675 | A | | 4/2000 | Holland et al. |
| 6,089,133 | A | | 7/2000 | Liao |
| RE36,797 | E | | 8/2000 | Eggert et al. |
| 6,095,658 | A | | 8/2000 | Kalousis |
| 6,138,537 | A | * | 10/2000 | Cole ..... 81/439 |
| 6,199,872 | B1 | | 3/2001 | Hasan |
| 6,209,428 | B1 | | 4/2001 | Anderson et al. |
| 6,220,129 | B1 | | 4/2001 | Shimansky |
| D442,455 | S | | 5/2001 | Shiao |
| 6,250,187 | B1 | | 6/2001 | Ju et al. |
| 6,327,942 | B1 | | 12/2001 | Mariol et al. |
| 6,332,384 | B1 | | 12/2001 | Cluthe |
| 6,502,484 | B2 | * | 1/2003 | Pao-Hsi ..... 81/439 |
| 2001/0029815 | A1 | | 10/2001 | Anderson et al. |
| 2001/0035079 | A1 | | 11/2001 | Kesinger et al. |
| 2001/0045145 | A1 | | 11/2001 | Legg |

* cited by examiner

*Primary Examiner*—James G. Smith
(74) *Attorney, Agent, or Firm*—Merchant & Gould PC

(57) ABSTRACT

A hand tool includes a rotatable bit cartridge for holding a plurality of stored bits and a retractable shaft that extends from a housing of the hand tool. A distal end of the retractable shaft includes a bit holder for holding a bit. Retracting the shaft within the housing of the tool causes the bit to be ejected from the distal end of the shaft and transported through an opening in the tool housing to the rotatable bit cartridge. The bit cartridge is then rotated to retrieve another bit and the shaft is then extended to transport the new bit through the opening in the housing and into alignment with the bit holder of the shaft. The shaft is further extended to engage the bit and extend the bit to an operative position outside of the tool housing. Example hand tools include a screwdriver and a power drill.

20 Claims, 8 Drawing Sheets

HAND TOOL WITH BIT CHANGING MECHANISM

TECHNICAL FIELD

The invention relates generally to hand tools having multiple interchangeable bits and, more particularly, to a bit storing and changing mechanism for such hand tools that allows a user to simply and rapidly interchange a first bit with a second stored bit without physically handling either bit.

BACKGROUND OF THE INVENTION

Hand tools such as screwdrivers and drills typically utilize a large number of bits of various sizes and configurations. For example, a screwdriver may utilize slotted, Phillips, hexagonal or star drive bits, and each different type of bit may come in various sizes. Similarly, power drill bits come in a wide variety of configurations and sizes for forming different sized holes in various different materials (e.g., different bits would normally be used for drilling in wood and in metal). It is inconvenient to store these different bits in a storage site that is separate from the hand tool due to the requirement to frequently access the storage site in order to change bits.

One solution to this problem is to store the bits within a storage compartment that is built into the hand tool itself, e.g., a compartment built into a drill casing or into the end of a screwdriver handle. Alternatively, slots or other cartridge systems may be attached to or formed on the body of the hand tool. However, such built-in storage compartments are often inconvenient to access, particularly when a user is at a work site (such as on a ladder) where it is difficult to gain access to the built in storage compartment. Even in those cases where the spare bits are easily accessible (such as when they are arrayed in circumferential grooves about a handle of a screwdriver) it may be difficult for a user to manually remove the bit from its stored location and then swap that bit with the one that is currently retained within a chuck or a bit holder of the hand tool.

Another solution to the above problems is to utilize a tool having an internal collection of bits that may be individually selected and moved to a working or distal end of the hand tool. Such solutions include providing a hollow shaft from the storage area to the distal end of the tool so that bits may be gravity fed directly from the storage area to a chuck or bit holder of the tool. Alternatively, a plurality of sliders may be provided within a body of the hand tool with a different bit attached to the end of each slider so that one slider/bit combination at a time may be extended through a distal opening of the tool. However, such solutions do not typically provide the ability to randomly change the bits that are internally stored within the hand tool. Rather, a selection of "popular" bits arc typically connected to the sliders, thus making such solutions inappropriate for those users that require a large variety of bit types and sizes.

A further solution is found in U.S. Pat. No. 4,572,038, entitled "Multi-Purpose Tool," issued Feb. 25, 1986, to Charles Graham. This patent describes a hand tool having a retractable shaft with a distal end supporting an interchangeable bit, and further describes a cylinder holding a plurality of bits within different chambers of the cylinder. The shaft normally extends through one of the cylinder chambers when the distal end of the shaft is in an extended or operational position. However, when the distal end of the shaft is retracted through the chamber of the cylinder, the cylinder may be rotated to align a different chamber (and thus a different bit) with the distal end of the shaft. Once the distal end of the shaft is coupled with the new bit, the shaft is extended through the new cylinder chamber to its operational position. One drawback to this patented tool is that specialized bits are required for mating with the distal end of the retractable shaft. Specifically, each bit includes an arcuate tongue that is rotated into coupling engagement with an arcuate groove formed in the distal end of the shaft. This curved tongue and groove arrangement is necessary to allow the different bits to rotate into and out of engagement with the distal end of the shaft as the cylinder is rotated. Thus, this patented tool can not be used with traditional bits having a hexagonal base. Of course, the vast majority of replaceable screwdriver bits (as well as a large number of drill bits) include a hexagonal base for use with hexagonal drivers and other multi-bit screwdrivers having a hexagonal-shaped bit holder. Thus, users would be unable to use their existing (hexagonal-based) bits with this patented tool. A further drawback to the above-described patented tool is that each bit must rotate into and out of engagement with the distal end of the shaft as the cylinder is rotated. Due to this limitation, the hand tool is likely to bind as a user changes from a first bit to a second bit that is several chambers away from the first bit on the cylinder. Lastly, the patented tool is cumbersome to work with since the cylinder is offset from the axis of the retractable shaft. Thus, a user would have to separately hold the tool housing or the cylinder itself and then rotate the handle at the rear of the tool to drive the bit. Such operation is contrary to the normal operation of a manual screwdriver where the entire tool is typically rotated around the axis of the shaft and/or the bit itself.

Thus, an improved hand tool is needed that will allow a user to automatically change bits stored within the tool while simultaneously allowing the user to load the tool with standardized bits such as the hexagonal-based bits that are prevalent with prior art multi-bit hand tools. It is with respect to these and other background considerations, limitations and problems that the present invention has evolved.

SUMMARY OF THE INVENTION

In accordance with the present invention, the above and other problems are solved by a multi-bit hand tool that includes a rotatable bit cartridge for holding a plurality of stored bits. A retractable shaft extends from the housing of the hand tool and a distal end of the shaft includes a bit holder for holding the bit (such as conventional hexagonal-based bits) during operation of the hand tool. The shaft is retracted within the tool housing to eject the bit from the distal end of the shaft and transport the bit through an opening in the tool housing to a vacant chamber of the rotatable bit cartridge. In one preferred embodiment, the bit cartridge is cylindrical in shape and is mounted coaxially with the retractable shaft.

One preferred embodiment of the present invention utilizes an inner shaft retained within a distal end of the outer shaft to eject the bit as the outer shaft is retracted within the tool housing. The inner shaft may include a stop that engages a fixed portion within the housing as the outer shaft is retracted so that a distal tip of the inner shaft protrudes from the distal end of the outer shaft to dislodge or eject the bit from the bit holder. The ejected bit is transported between the tool housing and the bit cartridge by a bit elevator that maintains a constant orientation of the bit. In one preferred embodiment, a pair of pivotable, parallel bars are connected between the tool housing and the bit elevator. Movement of the retractable shaft is coordinated with movement of the bit elevator so that the elevator engages the bit immediately after the bit is ejected from the distal end of the shaft. In one embodiment, the pivotable bars are driven through a linkage with the retractable shaft, such as a follower pin on the shaft that engages a track defined in the parallel bars as the shaft is retracted. The bit elevator moves the ejected bit through the opening in the housing and into the bit cartridge. The cartridge is then rotated so that the bit elevator can retrieve another bit and transport the new bit through the opening in the housing and into alignment with the bit holder of the retracted shaft. The shaft is then extended to engage the bit and extend the bit to an operative position outside of the tool housing.

In one preferred embodiment, the tool is a manual screwdriver requiring a user to manually retract a handle of the screwdriver to in turn retract the shaft and transport the bit to the bit cartridge. The user would then manually rotate the cartridge to select a new bit before returning the handle to (and the shaft with the newly inserted bit) to its normal, extended position. In another embodiment, the tool is a power drill where the motor that rotates the drill bit may also be used to drive the bit changing process by automatically retracting and extending the shaft. It is also possible for the drill motor to automatically rotate the bit cartridge so that a user may perform one-handed bit changes at the push of a button.

These and various other features as well as advantages, which characterize the present invention, will be apparent from a reading of the following detailed description and a review of the associated drawings.

DETAILED DESCRIPTION

Figure 1:
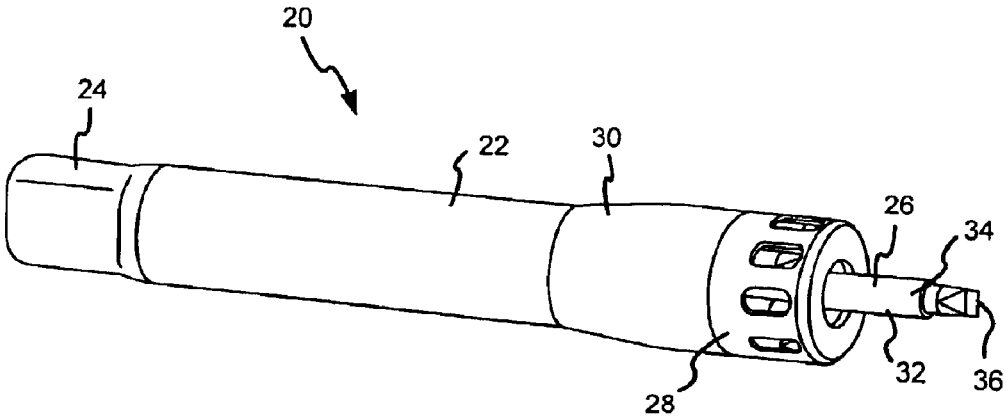
FIG. 1 is an isometric view of a hand tool comprising a manual screwdriver in accordance with an embodiment of the present invention illustrating a bit secured to a distal end of a shaft in an operative position of the screwdriver.

FIG. 1 illustrates an exemplary multi-bit hand tool 20 in accordance with one preferred embodiment of the present invention. Specifically, the hand tool 20 comprises a manual (non-motorized) screwdriver including a housing 22, a handle 24, a retractable outer shaft 26 extending from a distal end of the housing 22, and a rotatable bit cartridge 28 surrounding the shaft 26 at the distal end of the housing 22. The cartridge 28 is preferably attached to a sleeve 30 which in turn rotates over the distal end of the housing 22. The axis of rotation of the cylindrical cartridge 28 about the distal end of the housing 22 is thus substantially coaxial with an axis of rotation of the outer shaft 26.

A distal end 32 of the outer shaft 26 includes a bit holder 34 for holding an operative bit 36. Alternatively, the bit holder 34 may be formed integrally with the shaft 26. In the preferred embodiment, the bit holder 34 comprises a hexagonal cavity for holding a conventional bit having a hexagonal base. In this manner, the tool 20 of the present invention may be used with all such conventional bits rather than requiring the use of specialized bits as with some prior art multi-bit hand tools. While a slotted bit 36 is shown in FIG. 1, it is understood that a wide variety of bits may be used and stored in the cartridge 28. While the maximum length of the bit is limited by the size of the cartridge 28, it is further understood that the size of the cartridge may be increased for those embodiments of the tool 20 that might require longer bits. Additionally, the length of the shaft 26 (i.e., the length of that segment of the shaft that extends beyond the distal end of the housing 22) may be increased as necessary for a particular embodiment of the tool 20.

Figure 2:
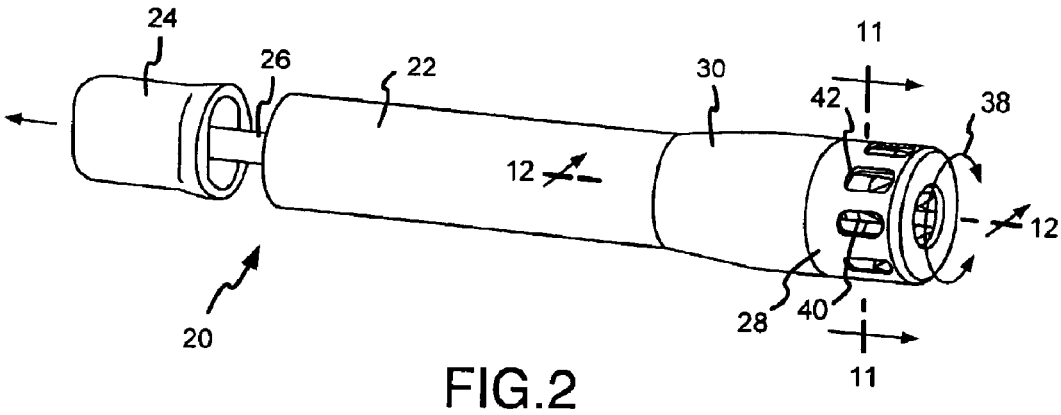
FIG. 2 is an isometric view of the screwdriver shown in FIG. 1 illustrating a handle retracting the distal end of the shaft and the bit within a housing of the screwdriver so that the: bit may be exchanged with another bit stored within a rotatable cartridge attached to the distal end of the housing.
Figure 10:
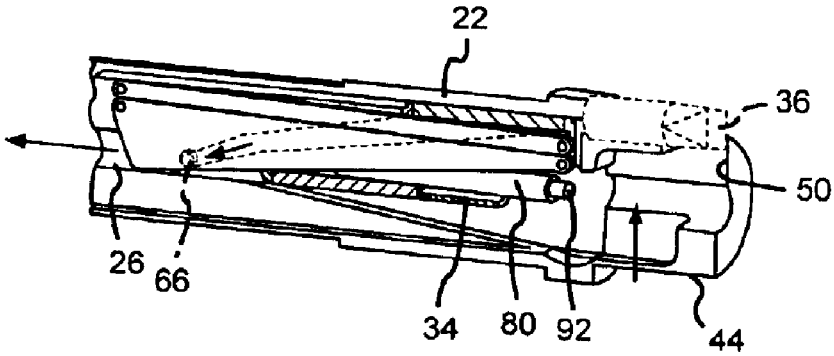
Figure 11:
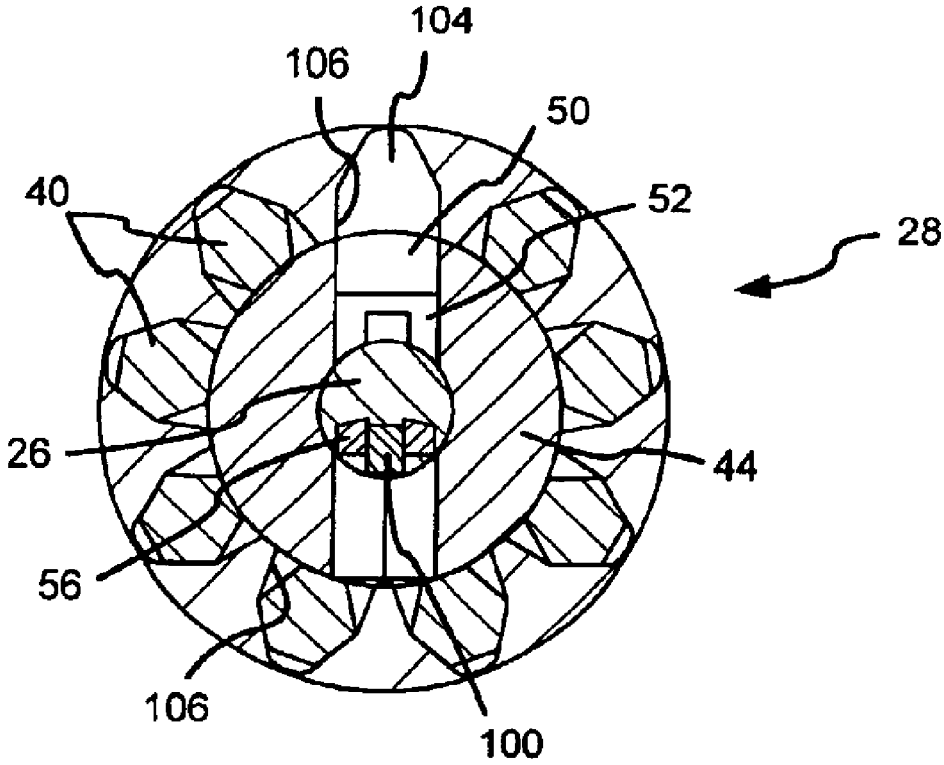
FIG. 11 is a section view of the rotatable bit cartridge taken substantially along the line 11—11 in FIG. 2.
Figure 12:
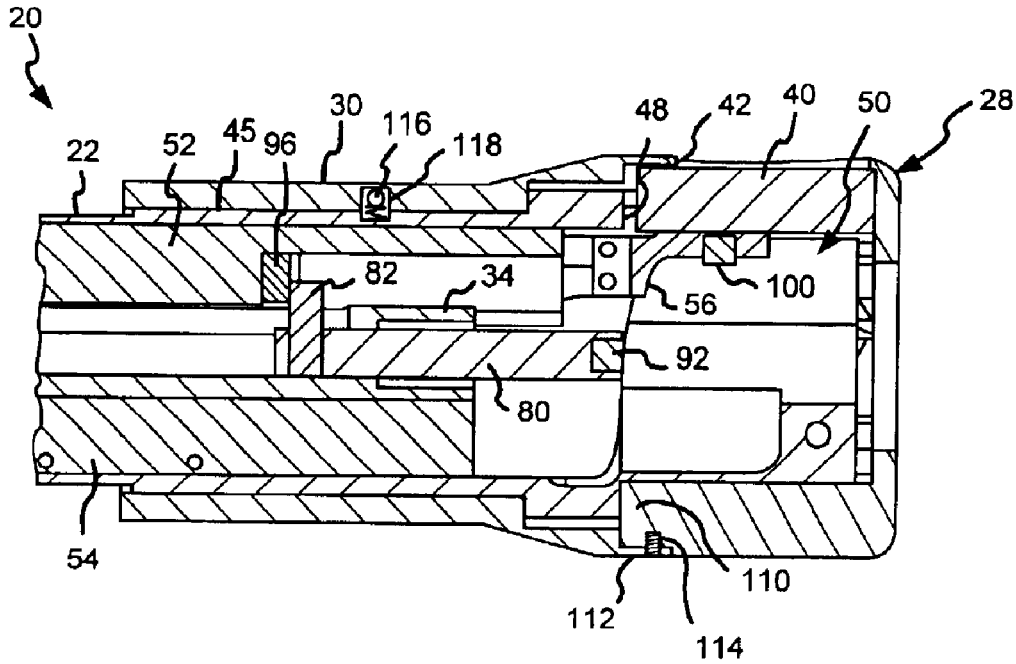
FIG. 12 is a section view taken substantially along the line 12—12 in FIG. 2 illustrating a fully retracted position of the shaft where the bit elevator is in its highest position either returning a bit or selecting a new bit within the rotatable bit cartridge.
Figure 13:
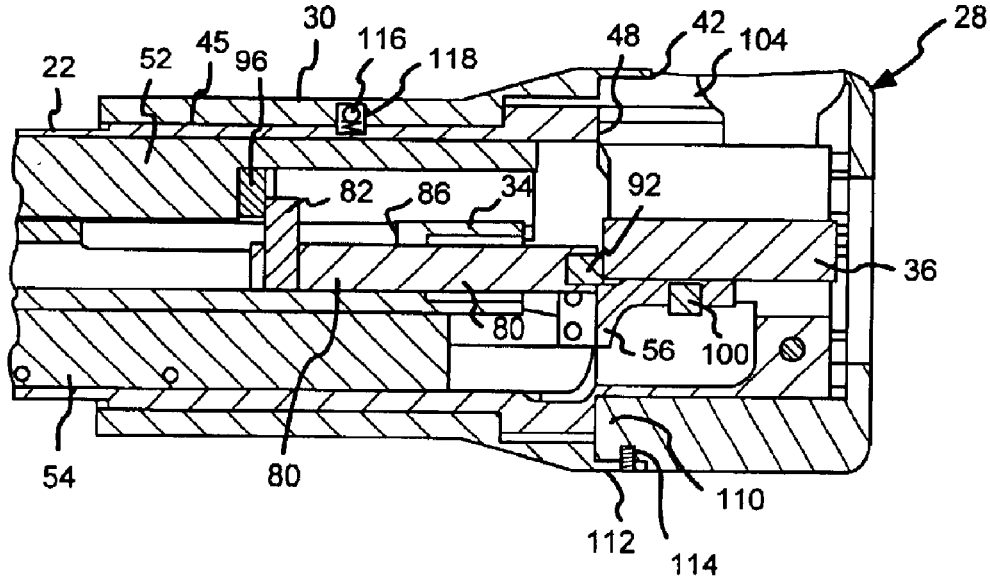
FIG. 13 is a section view similar to FIG. 12 illustrating the bit elevator retrieving a new bit from the rotatable bit cartridge and aligning the new bit with a magnet at a distal end of the inner shaft prior to extending the outer shaft over the inner shaft to seat the new bit within the bit holder at the distal end of the outer shaft.

While FIG. 1 illustrates an operative position of the tool 20, such as for driving a screw, FIG. 2 illustrates how the tool 20 is manipulated to change the operative bit 36. Specifically, a user would first pull back on the handle 24 to retract the outer shaft 26 and the operative bit 36 within the distal end of the housing 22. Continued retraction of the handle 24 and the attached shaft 26 operates to expel or eject the operative bit 36 from the bit holder 34 and transport the bit 36 through an opening (not shown in FIG. 2) in the housing 22 and into an open chamber within the cartridge 28 (this process is described in greater detail below with respect to FIGS. 5–10, while details of the cartridge 28 are shown in FIGS. 11–13). The user would then manually rotate the sleeve 30 and the attached cylindrical cartridge 28 either clockwise or counterclockwise (as shown by the arrow 38) until a desired storage bit 40 is aligned with the opening in the housing. The cartridge 28 preferably includes a plurality of windows 42 overlying each stored bit 40 to allow a user to visually confirm the bit that is to be substituted for the operative bit 36. Once the cartridge 28 is properly aligned, the handle 24 is returned to its normal position to transport the new operative bit 36 into axial alignment with the shaft 26 (as described in detail below). As the handle 24 returns to its operative position shown in FIG. 1, the distal end 32 of the shaft 26 once again protrudes from the distal end of the housing 22 with the new operative bit 36 retained within the bit holder 34.

Although in the preferred embodiment the bit cartridge 28 is formed separately from the sleeve 30, it is preferred that the cartridge 28 remain secured to the sleeve 30 during normal operation of the tool 20 (see FIGS. 12 and 13 described below). Thus, while it would be possible to utilize replacement cartridges 28 containing a different set of storage bits 40, it is preferred that the cartridge 28 remain fixed to the sleeve 30 and that different sets of storage bits be loaded within the cartridge 28 one at a time (i.e., loading a bit into the extended bit holder 34 and then retracting the bit into the interior of the housing and storing the bit in an open chamber of the cartridge). Once each new bit is stored, the sleeve 30 and the attached cartridge 28 are rotated to another chamber where the existing stored bit 40 (if any) is removed and a substitute bit is loaded within the bit holder 34 and again retracted within the housing and stored in the empty chamber of the cartridge 28. By allowing a user to pre-load the necessary bits 40 in the cartridge 28 prior to starting on a set of tasks, the chances are great that the tool 20 may be used on multiple tasks without the user ever having to manually handle a bit. Indeed, the ability of a user to continually change bits 40 without the danger of dropping or losing any of the bits is a major improvement of this invention over numerous prior art multi-bit tools. The detailed operation of the tool 20 is described below.

Figure 3A:
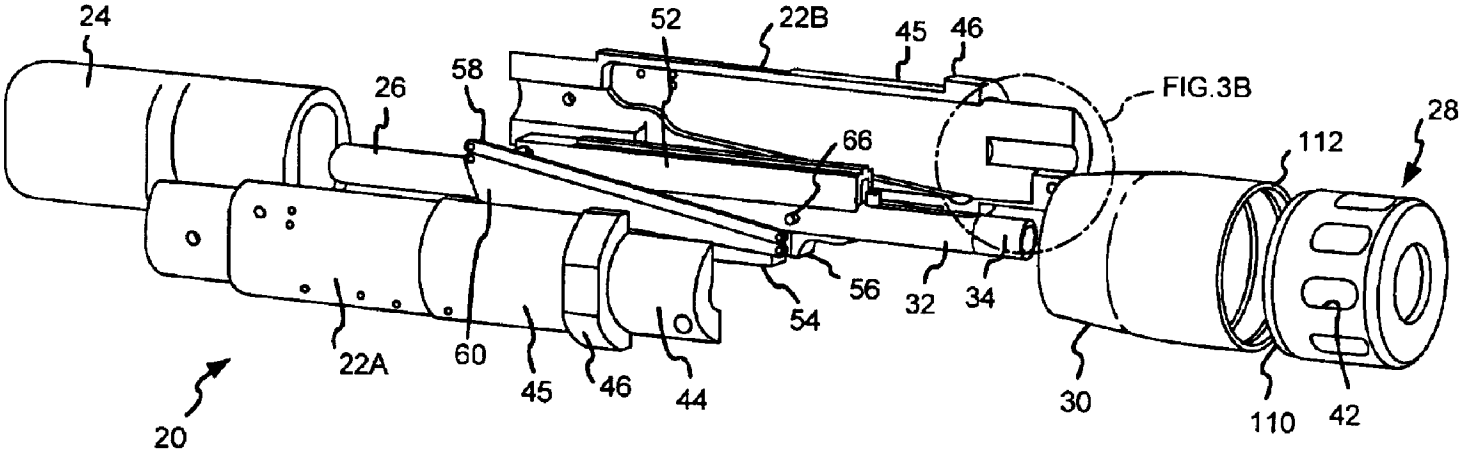
FIG. 3A is an exploded view of the screwdriver shown in FIG. 1.
Figure 3B:
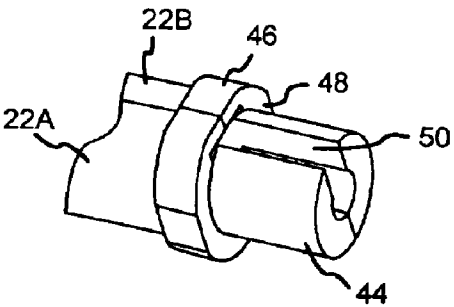
FIG. 3B is an enlarged isometric view of a distal portion of the housing illustrating an; opening through which a bit is exchanged with the rotatable cartridge.

FIG. 3A represents an exploded view of the major components of the tool 20, while FIG. 3B provides an enlarged illustration of a distal end 44 of the housing 22. FIGS. 3A and 3B illustrate that the housing 22 is preferably formed in two parts 22A and 22B for ease of manufacture. A slightly enlarged bearing surface 45 and a flange 46 adjacent the distal end 44 of the housing 22 provide support for the sleeve 30 to rotate relative to the housing 22 (as described below). Additionally, a distal surface 48 (FIG. 3B) of the flange 46 may also be used to support the bases of the stored bits 40, as best shown in FIG. 12. While the flange 46 extends around the entire circumference of the housing 22, the distal end 44 of the housing is preferably keyed to define a rectangular top opening 50 extending distally from the flange 46. This opening 50 is sufficiently large (both in width and length dimensions) to allow passage of the bits 36 and 40 through the opening 50, as described below.

FIG. 3A further illustrates upper and lower shaft supports 52 and 54, respectively, which supports are fixed within the housing 22 to provide a guide for the outer shaft 26 to slide relative to the housing 22. That is, each of the supports 52 and 54 include opposing arcuate surfaces to prevent off-axis movement of the shaft 26 while providing smooth bearing surfaces upon which the shaft 26 may slide. In addition to supporting sliding movement of the shaft 26, the upper shaft support 52 serves several additional functions, one of which is to provide a pivot anchor for a bit elevator 56 that is used to transfer bits 36 to and from the cartridge 28, as explained in greater detail below.

Figure 4:
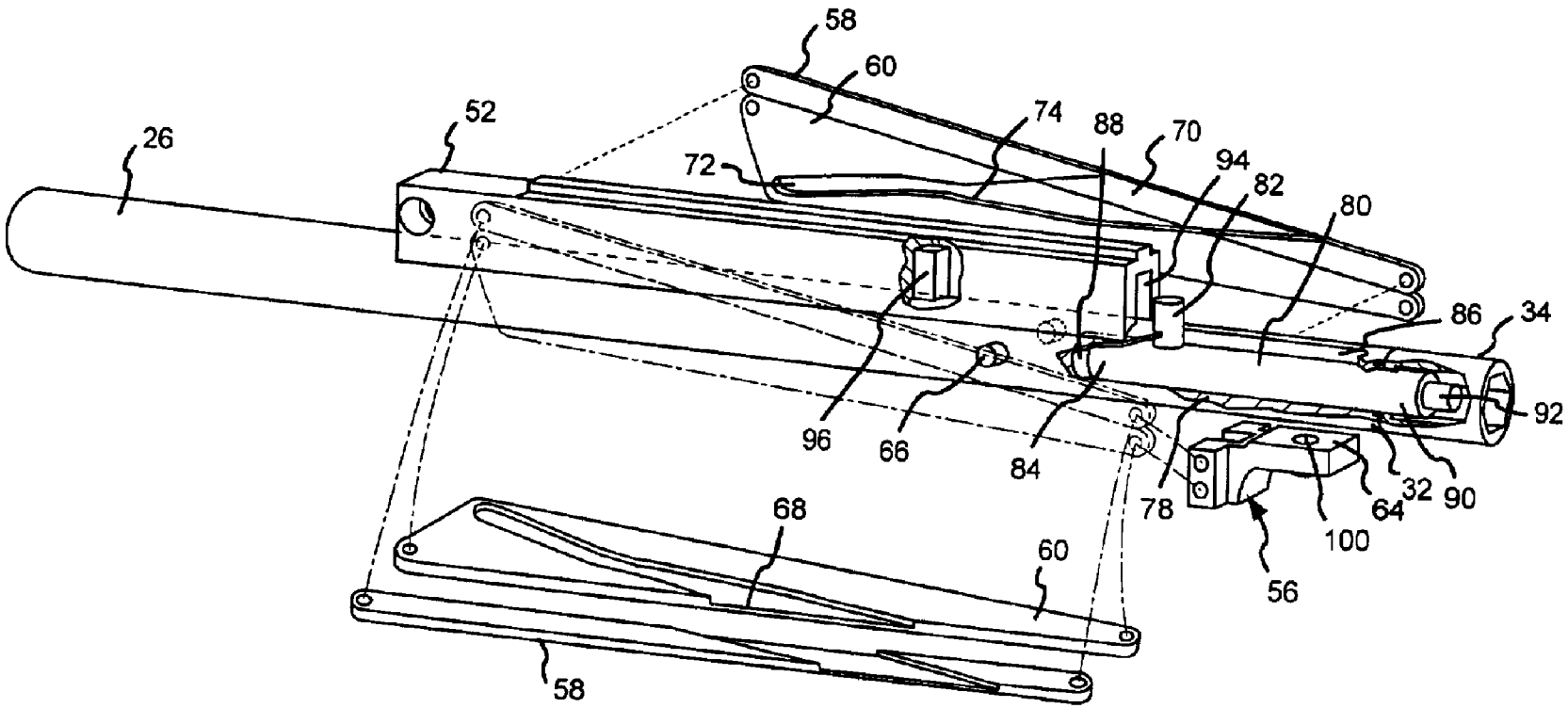
FIG. 4 is an enlarged exploded view of the shaft and a shaft support illustrating a four-bar arrangement that operate in conjunction with follower pins on the retractable shaft to alternately raise and lower a bit elevator as the shaft is retracted and extended relative to the fixed support. This exploded view further illustrates an inner shaft that is extended from the distal end of the outer shaft as the outer shaft is retracted.

Because it is important to maintain the orientation or alignment of the bit 36 (relative to an axis of rotation of the shaft 26) as the bit elevator 56 moves the bit from the housing 22 to the cartridge 28, the bit elevator 56 is preferably attached to a pivotable linkage. Specifically, a four-bar arrangement pivotably connects the bit elevator 56 to the upper shaft support 52, as best shown in FIG. 4. The four-bar arrangement includes two pairs of bars 58 and 60 on either side of the upper shaft support 52. That is, each pair of arms includes a top arm 58 and a bottom arm 60. While a first end of the arms 58 and 60 is pivotably connected to the upper shaft housing 52, a second end of the arms is pivotably connected to a rear portion of the bit elevator 56. As is well-known, the four-bar configuration (58 and 60) provides the ability to raise and lower the bit elevator 56 while maintaining a contact surface 64 of the bit elevator 56 parallel to the axis of the outer shaft 26. That is, by providing two pivot points on either side of the bit elevator 56, the elevator 56 will pivot as it rises to maintain a constant planar orientation of the contact surface 64. If only a single bar were used, the end of the bar would necessarily be fixed (as opposed to pivotably connected) to the bit elevator 56 so that the contact surface 64 would tilt as the bit elevator was raised.

Figure 5:
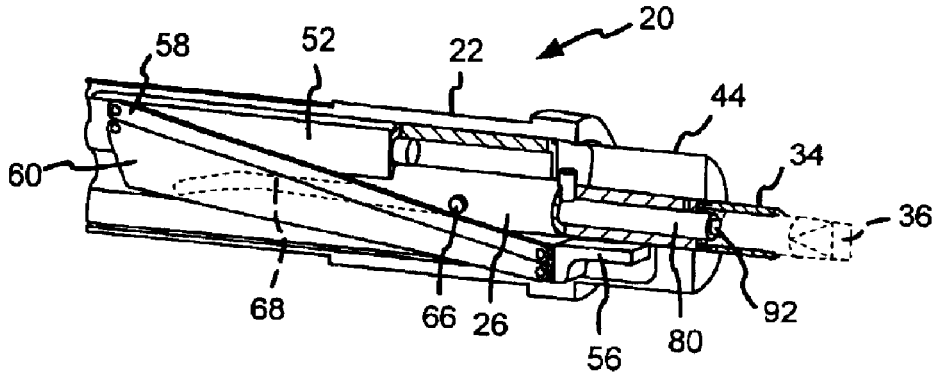
FIGS. 5–10 are a series of partial sectional views illustrating a bit changing sequence as the outer shaft is retracted within the housing of the screwdriver and the inner shaft protrudes from the outer shaft to eject the bit from a bit holder at the distal end of the outer shaft. The bit is then positioned to be engaged by the bit elevator shown in FIG. 4 which transports the bit upward through an opening in the screwdriver body and into the bit cartridge.
Figure 6:
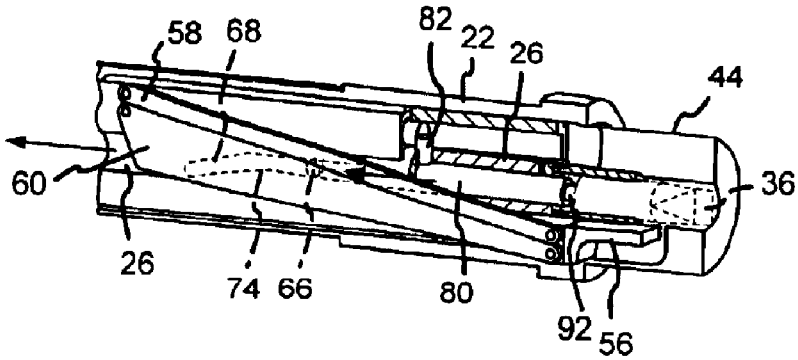
Figure 7:
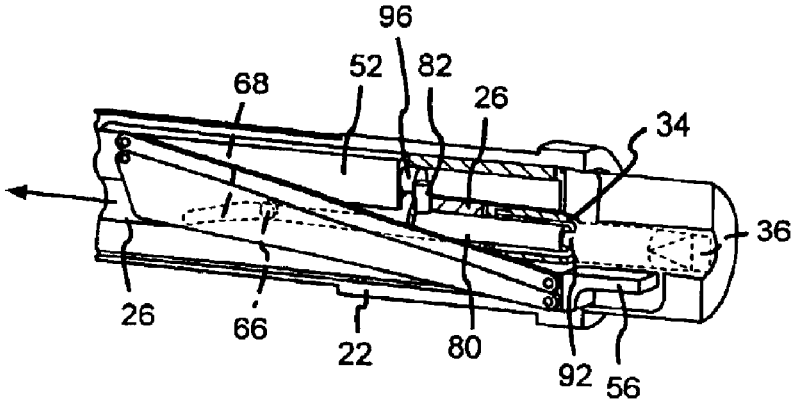
Figure 8:
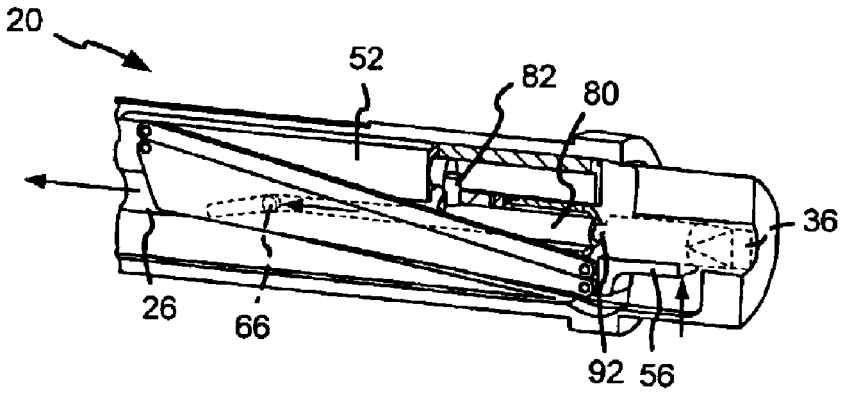
Figure 9:
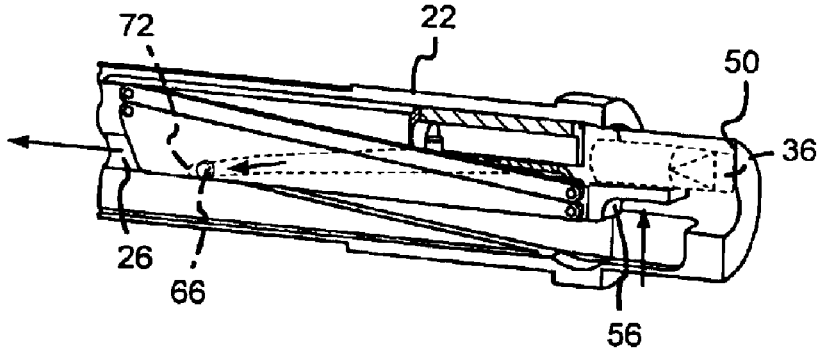

The bit elevator 56 is preferably raised and lowered with movement of the outer shaft 26 (i.e., the four bars 58 and 60 are pivoted about their ends fixed to the upper shaft support 52). Specifically, the bars 58 and 60 are preferably linked to the movement of the shaft 26 by a pair of follower pins 66, protruding from either side of the shaft 26, which move along a track or groove 68 formed in the inner surfaces of the bars 58 and 60. Of course, alternative means for raising the bit elevator 56 or pivoting the bars 58 and 60 (such as the use of a spring-loaded elevator 56) are encompassed within the scope of the present invention. However, in the preferred embodiment illustrated in FIG. 4, opposing tracks 68 are formed in both pairs of the upper and lower bars 58 and 60 of the four-bar arrangement. Thus, movement of the shaft 26 relative to the upper shaft support 52 (and thus relative to the bars 58 and 60 and the attached bit elevator 56) causes the follower pins 66 to enter a wide, open end 70 of the track 68 and proceed toward a closed end 72 of the track 68. A first segment of the track 68, adjacent the open end 70, is relatively straight and level so that the bit elevator 56 does not undergo any appreciable vertical movement while the pins 66 traverse this first segment of the opposing tracks 68 (FIGS. 5–7). However, as the follower pins 66 turn a corner 74 in each of the tracks 68, further rearward movement of the shaft 26 forces the bars 58 and 60 to pivot about their fixed ends so that the opposing ends of the bars (attached to the bit elevator 56) rise upward (FIGS. 8–10). The two different segments of the track 68 (i.e., an initial straight segment prior to the corner 74 and a downward angled segment after the corner 74) thus allow the bit elevator 56 to maintain its normal position below the shaft 26 until the distal end 32 of the shaft 26 has been retracted to a point behind the bit elevator 56. The bit elevator then "rises" to sweep away the bit 36 that has been expelled or ejected from the bit holder 34 at the distal end 32 of the shaft 26. This movement of the bit elevator is generally shown in the sequence found in FIGS. 5–10 (and specifically in FIGS. 8–10), which sequence is described in detail below. However, the operation of ejecting the bit 36 from the bit holder 34 is first described with respect to the exploded view of FIG. 4.

The distal end 32 of the outer shaft 26 (as shown in the cut-away portion of FIG. 4) includes a hollow interior compartment 78 that houses a relatively short inner shaft 80. The inner shaft 80 is permitted to slide within the compartment 78, although a preferably cylindrical stop 82 protruding upward from a proximal end 84 of the inner shaft 80 extends through a slot 86 formed in the outer shaft 26 to limit travel of the inner shaft 80 relative to the outer shaft 26. A magnet 88 fixed in a proximal end of the interior compartment 78 preferably maintains the inner shaft 80 in a retracted position within the compartment 78 (as shown in FIG. 4) and prevents a distal end 90 of the inner shaft 80 from being inadvertently extended beyond the distal end 32 of the outer shaft 26 (such as through the force of gravity).

In an operative position of the outer shaft 26 (such as shown in FIG. 4), the distal end 90 of the inner shaft 80 extends approximately to the bit holder 34 so that a magnetic tip 92 fixed to the distal end 90 of the inner shaft 80 preferably extends into a bottom or proximal end of the bit holder 34 to help secure a bit 36 within the bit holder 34. Thus, in normal use of the hand tool 20, the magnet 88 retains the inner shaft 80 in a retracted position (as shown in FIG. 4), and the magnetic tip 92 serves to retain the bit 36 in place in the bit holder 34 (such as against the force of gravity). However, when the outer shaft 26 is retracted within the housing 22 (not shown in FIG. 4), the inner shaft 80 is initially allowed to retract with the outer shaft 26 and is then held in place (by contact with the stop 82) so that the magnetic tip 92 passes through the bit holder 34 as the outer shaft 26 is continually retracted. That is, movement of the inner shaft 80 relative to the outer shaft 26 tends to force or "eject" the bit 36 from the bit holder 34. It is preferred that the bit 36 not be ejected from the confines of the bit holder 34 until the bit elevator 56 is in position to receive the bit 36. Thus, it is preferred that the inner shaft 80 stay recessed within the interior compartment 78 of the outer shaft 26 until the bars 58 and 60 start to raise the bit elevator 56 (as described above). Toward this end, the upper shaft support 52 preferably includes an open distal portion 94 that receives the stop 82 on the inner shaft 80 as the outer shaft 26 is retracted (i.e., moved to the left in FIG. 4). A rear or proximal end of the open distal portion 94 includes a stop magnet 96 for engaging and holding the metallic stop 82. Once the stop 82 engages the stop magnet 96 (FIG. 6), continued movement of the outer shaft 26 causes the inner shaft 80 to break the magnetic bond with the magnet 88 in the interior compartment 78 so that the stop 82 moves forward through the slot 86 in the outer shaft 26, and so the magnetic tip 92 pushes the bit (not shown in FIG. 4) beyond the confines of the bit holder 34. It is at this point that the bit elevator 56 engages and holds the bit 36 via a magnet 100 contained in the contact surface 64 of the bit elevator. Continued rearward movement of the shaft 26 then causes the bit elevator to rise further and transfer the bit 36 from the housing 22 to the cartridge 28 through the opening 50 in the housing (FIG. 3B). While transfer of the bits to and from the cartridge 28 is described in greater detail below, the relative movement of the outer and inner shafts 26 and 80, as well as the movement of the bars 58 and 60 and the bit elevator 56 is now described in detail with respect to the series of illustrations in FIGS. 5–10.

FIG. 5 illustrates an operative position of the tool 20 where the bit 36 extends beyond the distal end 44 of the housing 22. Specifically, FIG. 5 shows that the inner shaft 80 is fully retracted within the outer shaft 26 so that the magnetic tip 92 is used to help retain the bit 36 within the bit holder 34. Similarly, the follower pins 66 on either side of the shaft 26 have not yet engaged the tracks 68 (shown in phantom) formed in the two pairs of bars 58 and 60. Thus, the bit elevator 56 is in stored position in the bottom of the housing 22.

FIG. 6 illustrates a first step in a bit change procedure where the outer shaft 26 is initially retracted to a point where the bit 36 is retracted within the distal end 44 of the housing 22. At this point, the inner shaft 80 is still fully retracted within the outer shaft 26 and the magnetic tip 92 at the end of the inner shaft still helps to hold the bit 36 securely within the bit holder 34. It is also noted that the follower pins 66 have now entered and traversed the first segment of the track 68 (between the open end 70 and the corner 74) formed in the bars 58 and 60. However, as noted above, the first segment of the track 68 is substantially flat or straight so that the position of the bars 58 and 60 (and thus the position of the bit elevator 56) remains substantially unchanged as between FIGS. 5 and 6.

FIG. 7 illustrates a next step in the retraction of the outer shaft 26. While the inner shaft 80 was fully retracted within the outer shaft 26 in FIG. 6, the stop 82 on the inner shaft was engaged with the stop magnet 96 fixed within the upper shaft support 52 (shown partially cut away to permit visualization of the stop magnet 96). Thus, the further movement of the outer shaft 26 shown in FIG. 7 causes the inner shaft to start to move relative to the outer shaft 26. That is, the stop magnet 96 maintains the position of the inner shaft 80 relative to the housing 22, while the outer shaft 26 is retracted relative to the housing 22. Thus, the inner shaft stop 82 begins to move forward through the slot 86 (FIG. 4) formed in the distal end of the outer shaft 26. This relative movement of the inner shaft 80 and the outer shaft 26 causes the magnetic tip 92 at the distal end of the inner shaft 80 to eject the bit 36 from the bit holder 34. Simultaneously, each of the follower pins 66 have reached the corner 74 of their respective tracks 68 of the four-bar arrangement (58 and 60) so that further rearward movement of the shaft 26 will result in upward movement of the bit elevator 56. It is noted that terms such as "rearward" and "upward" are used for convenience to better explain the illustrations and do not constitute a limitation on the present invention. That is, because magnets (e.g., magnets 88 and 100) are used to maintain the position of the bit 36 during the sequence shown in FIGS. 5–10, the tool 20 could be inverted so that the elevator 56 would move "downward" to eject the bit 36 from the housing 22.

FIG. 8 illustrates further retraction or rearward movement of the outer shaft 26 which results in upward movement (in the orientation of FIG. 8) of the bit elevator 56. The magnet 100 (FIG. 4) in the contact surface 64 of the bit elevator 56 immediately engages the bit 36 once the bit has been ejected from the bit holder 34 as described with respect to FIG. 7. As noted above, the inner shaft 80 remains fixed in place during the sequence of FIGS. 7–10 and thus the magnetic tip 92 helps to maintain the position of the bit 36 until the bit elevator 56 and its magnet 100 engage the bit as shown in FIG. 8.

FIGS. 9 and 10 illustrate the final movement of the outer shaft 26 as the follower pins 66 move to the closed end 72 of the track 68 and the bit elevator 56 rises to its highest point. FIG. 9 shows the elevator 56 moving the bit 36 out of contact with the magnetic tip 92 of the inner shaft 80 and into the opening 50 formed in the housing 22, while FIG. 10 shows the further movement of the bit through the opening 50 and into the cartridge 28 (not shown in FIG. 10). It should be noted that, like the opening 50 in the housing 22, the size of the bit elevator 56 may be increased as necessary to support bits of varying sizes. Additionally, while FIGS. 5–10 detail the linkage of the shaft 26 to the bit elevator 56 using the follower pins 66 and the tracks 68, it is understood that alternative linkages may be provided between the shaft 26 and the bit elevator 56 and that all such linkages are encompassed within the present invention. Indeed, the bit elevator 56 need not be linked directly to the shaft 26, and such alternative driving means for the elevator 56 (such as a spring-loaded mechanism) are also encompassed by the present invention.

Of course, the sequence of FIGS. 5–10 is followed in reverse once a new bit (i.e., one of the stored bits 40) has been loaded onto the contract surface 64 of the bit elevator 56. That is, the handle 24 and thus the outer shaft 26 is moved in the opposite direction from the arrows shown in FIGS. 6–10 to first drop the bit elevator 56 from its raised position until the bit 36 is aligned with the magnetic tip 92 of the inner shaft 80 (FIGS. 10, 9 and 8, in sequence). Next, the outer shaft 26 is continually moved forward until the bit holder 34 surrounds the hexagonal base of the bit 36 (FIGS. 7 and 6). Finally, once the inner shaft 80 has been retracted within the compartment 78 of the outer shaft 26 (i.e. at the transition between FIG. 6 and FIG. 5), further movement of the outer shaft 26 breaks the magnetic engagement between the metallic stop 82 on the inner shaft 80 and the stop magnet 96 so that the distal end 32 of the outer shaft 26 (with the secured bit 36) can be extended from the distal end 44 of the housing 22 (FIG. 5).

FIGS. 11–13 illustrate cross sectional views of the cartridge 28 taken from different planes in FIG. 2. FIG. 11 illustrates that the cartridge 28 surrounds the distal end 44 of the housing 22 and preferably includes nine separate bit-holding chambers 104 (although a greater or smaller number of chambers 104 may be utilized). Each chamber 104 has an inner opening 106 that is preferably the same width as the opening 50 found in the distal end of the housing 22. In this manner, the cartridge 28 may be rotated relative to the distal end 44 of the housing 22 until a predetermined chamber 104 is aligned with the opening 50. Thus, in the case where an operative bit 36 is contained within the bit holder 34 and it is desired to exchange the bit 36 with a stored bit 40, an empty chamber 104 must be aligned with the opening 50 as shown in FIG. 11. Indeed, it is likely that the empty chamber 104 will have once housed the operative bit 36 provided that the cartridge 28 has not been rotated since loading the bit 36 within the bit holder 34. In any event, once the open chamber 104 is aligned with the opening 50 in the housing 22, the sequence of FIGS. 5–10 may be followed to eject the operative bit 36 from the bit holder 34 and "elevate" or transport the bit 36 through the opening 50 and into the vacant chamber 104 shown in FIG. 11.

Once the operative bit 36 has been stored in an empty chamber 104, the cartridge 28 is rotated until a desired one of the stored bits 40 is positioned over the opening 50 in the housing 22. An indicator mark (not shown) is preferably formed on the handle 24 in line with the opening 50 in the housing to assist the user in determining how far to rotate the cartridge 28 (and the attached sleeve 30) to align the desired bit 40 with the opening 50. As described below, a detent system may be used as the sleeve 30 rotates over the bearing surface 45 of the housing 22 to aid the user in obtaining proper alignment between the chambers 104 and the opening 50. Once the desired bit 40 is aligned, the sequence of FIGS. 10 to 5 is followed (in that order) to transport the bit 40 through the opening 50 and into alignment with the distal end 32 of the shaft 26. Specifically, rotation of the cartridge 28 while the handle 24 is fully retracted brings different ones of the bits 40 into contact with the magnet 100 in the contract surface of the bit elevator 56. Once the desired bit is aligned with the opening, i.e., once the bit elevator 56 is magnetically attached to the bit 40 as shown in FIG. 12, the handle 24 is returned to the extended position to transport the bit 40 from its chamber 104 in the cartridge 28 through the opening 50 and into the distal end 44 of the housing 22 (as shown in FIG. 13). Further movement of the handle 24 and the shaft 26 aligns the bit with the bit holder 34 and extends the distal end 32 of the outer shaft 26 and the bit holder 34 about the hexagonal base of the bit (see FIGS. 7 and 6 in that order). The distal end 32 of the shaft 26 is then extended from the distal end 44 of the housing 22 to an operative position, as shown in FIG. 5.

FIGS. 12 and 13 illustrate that a proximal end 110 of the cylindrical cartridge 28 is preferably attached to a distal circumferential edge 112 of the sleeve 30 by a fastener 114. In this manner, the cartridge 28 rotates with the sleeve 30 as the sleeve 30 rotates over the bearing surface 45 and the flange 46 of the housing 22. Additionally, a compressible detent 116 (e.g., a spring-loaded ball) is preferably formed in the bearing surface 45 of the housing 22 to engage recesses or ports 118 that are spaced about the sleeve 30. Each recess 118 in the sleeve 30 is preferably aligned with one of the chambers 104 in the cartridge 28. Thus, as a user rotates the sleeve 30 and the attached cartridge 28 to change bits, the detent 116 will engage each of the recesses 118 in the sleeve 30 and provide accurate alignment of the chamber 104 with the opening 50 in the housing (as shown in FIG. 11).

In a preferred embodiment, both the cartridge 28 and the sleeve 30 are molded from plastic to simplify construction of the tool 20, particularly in light of the complex shape of each of the bit holding chambers 104 and the inclusion of the windows 42 to display the actual bits 40 stored within the chambers 104. That is, a molded plastic cartridge 28 is cheaper and simpler to form than a metal cartridge. Additionally, the plastic sleeve 30 will slide easily over the metal bearing surface 45 of the housing 22 without the use of an extra bearing between the sleeve 30 and the housing 22. Of course, one skilled in the art may utilize alternative means for rotating the sleeve 30 or cartridge 28 relative to the housing 22 (and for aligning the chambers 104 with the opening 50 in the housing), and all such alternative means are understood to be encompassed within the scope of the present invention.

Similarly, the handle 24 is also preferably formed from plastic to reduce the weight of the overall tool 20. Further weight savings are achieved by forming the majority of the components (such as the housing 22, the upper and lower shaft supports 52 and 54, as well as the outer shaft 26 itself) from a relatively light metal material such as aluminum. However, certain other components of the tool 20 are preferably formed from steel or another metal having magnetic properties. For example, the stop 82 on the inner shaft 80 must be capable of being magnetically retained by the stop magnet 96. Indeed, in one embodiment, the entire inner shaft 80 is preferably made of steel so that the shaft 80 is firmly gripped by the magnet 88 in the proximal end of the interior compartment 78. Furthermore, while each of the magnets 88, 92 and 100 described above are preferably made from neodymium, alternative magnetic materials may be substituted for the neodymium magnets.

Figure 14:
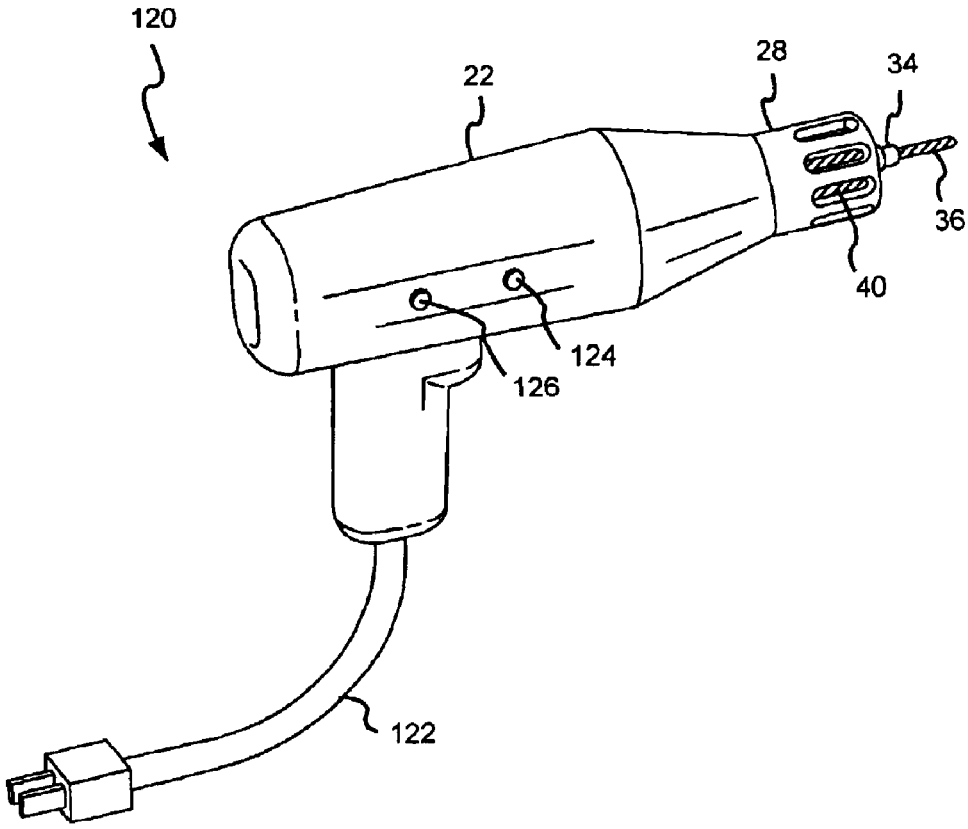
FIG. 14 is an isometric view of an alternative embodiment of the hand tool of the present invention comprising a power drill.

While FIGS. 1–13 describe one preferred embodiment 20 of a hand tool (i.e., a manually powered screwdriver), FIG. 14 generally illustrates a second, alternative embodiment 120 of the tool comprising an electric power drill. The drill 120 includes an electric motor (not separately shown) and a power cord 122 to provide electrical current to the motor. However, in other respects, the drill 120 is similar to the screwdriver 20 in that a distal end of an outer shaft includes a bit holder 34 for holding an operative bit 36, while a rotatable cartridge 28 at the end of the housing 22 holds a plurality of stored bits 40.

While the electric motor (not separately shown in FIG. 14) typically operates to turn the outer shaft and thus provide torque to the bit 36, one skilled in the art may also utilize the motor to drive the bit changing sequence shown in FIGS. 5–10. That is, the electric motor could operate to retract the outer shaft within the housing 22 which in turn retracts the operative bit 36 within the housing 22 and drives the bit elevator to transport the bit 36 to a vacant chamber 104 in the cartridge 28. For example, the drill 120 could include a first conventional trigger mechanism (not shown) for rotating the shaft (and thus the bit 36), and a second trigger mechanism 124 for driving the bit-changing sequence. This second trigger 124 could, for example, be pressed once to retrieve and store the bit 36 in an open chamber in the cartridge 28, and then be pressed again once the user has rotated the cartridge 28 to the necessary position to retrieve a desired one of the stored bits 40 and load the bit within the bit holder 34. Alternatively, the second trigger 124 may retrieve the bit 36 as described above and then automatically rotate the cartridge 28 one position (e.g., clockwise) to retrieve the bit 40 from the next adjacent chamber 104. In this manner, a user could change bits while holding the drill 120 in one hand (such as when balanced on a ladder). Additionally, separate triggers 124 and 126 may be provided for rotating the cartridge 28 either clockwise or counter-clockwise before changing bits so that a desired bit 40 is never more than half a cartridge away from the chamber where the operative bit 36 was stored.

It will be clear that the present invention is well adapted to attain the ends and advantages mentioned as well as those inherent therein. While certain preferred embodiments have been described for purposes of this disclosure, various changes and modifications may be made which are well within the scope of the present invention. For example, alternative means (such as a spring-loaded mechanism) may be used to drive the bit elevator 56. Additionally, while the bit holder 34 has been described as a separate component fixed to the distal end 32 of the outer shaft 26, one preferred design simply forms the bit holder 34 integrally with the end of the shaft 26. Additionally, the size and shape of the housing 22 as well as the size of the opening 50 and the bit elevator 56 may change to reflect different types of multi-bit hand tools (e.g., a screwdriver versus a power drill). Furthermore, the size of the cartridge 28 and the number of chambers 104 contained within the cartridge may be varied with different types of hand tools or to suit the needs of various users. Numerous other changes may be made which will readily suggested themselves to those skilled in the art and which are encompassed in the scope of the invention disclosed and as defined in the appended claims.

What is claimed is:

1. A hand tool comprising:

a housing;

a shaft holding a bit at a distal end of the shaft, the shaft mounted for sliding movement relative to the housing between an extended position where the bit protrudes beyond a distal end of the housing and a retracted position where the bit is retracted within the housing;

a cylindrical bit cartridge rotatably mounted to the distal end of the housing and having an axis of rotation substantially coaxial with an axis of rotation of the shaft, the bit cartridge defining a plurality of chambers for holding a plurality of stored bits;

means for ejecting the bit from the distal end of the shaft as the shaft is moved to the retracted position; and means for transporting the bit through an opening in the housing and into a vacant chamber of the bit cartridge, wherein the means for ejecting the bit from the distal end of the shaft includes an inner shaft retained within the distal end of the first aforesaid shaft, the inner shaft biased to a retracted position within the first shaft, and the inner shaft including a stop that contacts a portion of the housing to move the inner shaft from the retracted position to an extended position as the first shaft is moved from the extended position to the retracted position, and wherein a distal tip of the inner shaft contacts the bit to eject the bit from the distal end of the first shaft as the inner shaft moves from the retracted position to the extended position.

2. A hand tool as defined in claim 1 wherein the distal tip of the inner shaft is magnetized and contacts the bit to help secure the bit within the distal end of the first shaft when the inner shaft is in the retracted position.

3. A hand tool comprising:

a housing;

a shaft holding a bit at a distal end of the shaft, the shaft mounted for sliding movement relative to the housing between an extended position where the bit protrudes beyond a distal end of the housing and a retracted position where the bit is retracted within the housing;

a cylindrical bit cartridge rotatably mounted to the distal end of the housing and having an axis of rotation substantially coaxial with an axis of rotation of the shaft, the bit cartridge defining a plurality of chambers for holding a plurality of stored bits;

means for ejecting the bit from the distal end of the shaft as the shaft is moved to the retracted position; and a bit elevator for transporting the bit through an opening in the housing and into a vacant chamber of the bit cartridge, wherein the bit elevator moves the bit while maintaining an axis of rotation of the bit parallel to the axis of rotation of the shaft.

4. A hand tool as defined in claim 3 wherein the means for transporting the bit through the opening in the housing further comprises at least one pair of parallel bars having first ends pivotably attached to the housing and having second ends pivotably attached to the bit elevator.

5. A hand tool as defined in claim 4 further comprising at least one follower pin extending from the shaft, wherein the follower pin engages a track defined in the at least one pair of parallel bars to pivot the pair of parallel bars about their first ends as the shaft is moved between the extended and retracted positions.

6. A hand tool as defined in claim 3, wherein the hand tool comprises a screwdriver.

7. A hand tool as defined in claim 3, wherein the hand tool comprises a drill.

8. A hand tool as defined in claim 3, further comprising a motor to automatically move the shaft between the extended and retracted positions.

9. A hand tool comprising:

a housing;

a rotatable bit cartridge attached to a distal end of the housing;

an outer shaft having a distal end for holding a bit, the outer shaft moveable between an extended position and a retracted position relative to the housing;

an inner shaft moveable between a retracted position within the distal end of the outer shaft and an extended position protruding from the distal end of the outer shaft to eject the bit from the distal end of the outer shaft, wherein the inner shaft moves from the retracted position to the extended position as the outer shaft moves from the extended position to the retracted position; and a bit elevator having a contact surface for engaging the ejected bit, the bit elevator moveable between a first position within the housing and a second position within the rotatable bit cartridge to transport the ejected bit to a storage position within the cartridge as the outer shaft moves to a fully retracted position.

10. A hand tool as defined in claim 9 wherein the rotatable bit cartridge has an axis of rotation that is substantially coaxial with an axis of rotation of the outer shaft.

11. A hand tool as defined in claim 10 wherein the bit cartridge defines a plurality of chambers for holding a plurality of bits, each bit having a base adapted to be received within the distal end of the outer shaft.

12. A hand tool as defined in claim 11, wherein the hand tool comprises a screwdriver.

13. A hand tool as defined in claim 11, wherein the hand tool comprises a drill.

14. A hand tool as defined in claim 11, further comprising a motor within the housing to automatically move the outer shaft between the extended and retracted positions.

15. A method of changing bits within a hand tool, wherein a cartridge containing a plurality of stored bits is rotatably mounted to a distal end of a housing of the hand tool, and wherein a first bit is retained within a distal end of a shaft extending from the distal end of the housing, the method comprising steps of:

retracting the distal end of the shaft within the distal end of the housing;

ejecting the first bit from the distal end of the shaft;

transporting the first bit through an opening in the housing to store the first bit in the cartridge;

rotating the cartridge to align a stored second bit with the opening in the housing;

transporting the second bit through the opening in the housing and into alignment with the distal end of the shaft; and extending the distal end of the shaft to engage the second bit and extend the second bit to an operative position beyond the distal end of the housing.

16. A method as defined in claim 15 wherein the rotatably mounted cartridge has an axis of rotation that is substantially coaxial with an axis of rotation of the shaft.

17. A method as defined in claim 16 wherein:

the steps of ejecting the first bit and transporting the first bit are performed during the step of retracting the distal end of the shaft; and the step of transporting the second bit is performed during the step of extending the distal end of the shaft.

18. A method as defined in claim 16, wherein the steps of retracting the distal end of the shaft and extending the distal end of the shaft are performed by a motor contained within the housing.

19. A method as defined in claim 16, wherein the hand tool comprises a screwdriver.

20. A method as defined in claim 16, wherein the hand tool comprises a drill.

* * * * *